US005241799A

United States Patent [19]

Jahn

[11] Patent Number: 5,241,799

[45] Date of Patent: Sep. 7, 1993

[54] OPEN CELL LAY-IN PANEL

[75] Inventor: Martin D. Jahn, Chicago, Ill.

[73] Assignee: Chicago Metallic Corporation, Chicago, Ill.

[21] Appl. No.: 804,364

[22] Filed: Dec. 10, 1991

[51] Int. Cl.[5] ..... E06B 3/54

[52] U.S. Cl. ..... 52/484; 52/664; 52/28

[58] Field of Search ..... 52/28, 39, 485, 486, 52/484, 482, 473, 475, 476, 664, 667, 668

[56] References Cited

U.S. PATENT DOCUMENTS

| | | |
|---|---|---|
| D. 22,273 | 3/1893 | Grafton et al. . |
| D. 29,933 | 1/1899 | Hodge . |
| D. 90,096 | 6/1933 | Beam . |
| D. 117,643 | 11/1939 | Stewart . |
| D. 135,853 | 6/1943 | Cohn . |
| D. 156,765 | 1/1950 | Quin . |
| D. 177,149 | 3/1956 | Prince . |
| D. 186,362 | 10/1959 | Saathoff . |
| D. 208,367 | 8/1967 | Blitzer, Jr. . |
| D. 214,683 | 7/1969 | Deutsch . |
| D. 260,040 | 7/1981 | Maresca . |
| D. 269,707 | 7/1983 | Thual . |
| 2,108,795 | 2/1938 | Budd . |
| 2,825,800 | 3/1958 | Spott . |
| 3,291,978 | 12/1966 | Greenberg et al. . |
| 3,313,932 | 4/1967 | Deaton . |
| 3,327,444 | 6/1967 | Downing, Jr. . |
| 3,378,980 | 4/1968 | Blitzer, Jr. . |
| 3,471,981 | 10/1969 | Segil et al. . |
| 3,491,500 | 1/1970 | Fischer . |
| 3,596,425 | 8/1971 | Kodaras . |
| 3,685,238 | 8/1972 | Fisher et al. . |
| 3,755,988 | 9/1973 | Van Der Sluys . |
| 3,774,024 | 11/1973 | Deaton . |
| 3,807,116 | 4/1974 | Flynn . |
| 3,812,341 | 5/1974 | Cohen . |
| 3,906,697 | 9/1975 | Rijnders . |
| 3,969,870 | 7/1976 | Deaton . |
| 3,987,598 | 10/1976 | Rijnders . |
| 3,996,458 | 12/1976 | Jones et al. . |
| 4,023,681 | 5/1977 | Plant . |
| 4,034,534 | 7/1977 | Taylor . |
| 4,222,094 | 9/1980 | Wolar . |
| 4,282,695 | 8/1981 | Lew . |
| 4,569,175 | 2/1986 | Abciuk . |
| 4,625,470 | 12/1986 | Heritage . |
| 4,640,075 | 2/1987 | Nuncio . |
| 4,720,954 | 1/1988 | Scoones . |
| 4,794,745 | 1/1989 | Platt et al. . |
| 4,848,054 | 7/1989 | Blitzer et al. . |
| 4,916,877 | 4/1990 | Platt ..... 52/484 X |
| 4,949,517 | 8/1990 | Blitzer et al. ..... 52/484 X |

FOREIGN PATENT DOCUMENTS

| | | | |
|---|---|---|---|
| 2485592 | 12/1981 | France | 52/484 |
| 2142356 | 1/1985 | United Kingdom . | |

*Primary Examiner*—Carl D. Friedman
*Assistant Examiner*—Creighton Smith
*Attorney, Agent, or Firm*—Hill, Steadman & Simpson

[57] ABSTRACT

An open-cell lay-in panel for use in a suspended ceiling is formed by at least two strip members which are interconnected together and have at least a portion of each strip member supported on flanges of the runners adjacent opposite corners of the square opening. The strip members may be arranged to form an open-cube arrangement and they may have bent portions to give a different configuration to the structure.

30 Claims, 4 Drawing Sheets

OPEN CELL LAY-IN PANEL

BACKGROUND OF THE INVENTION

The present invention is directed to a suspended ceiling structure having main runners and interconnected cross runners forming a grid with rectangular openings for receiving an open cell lay-in panel which is formed of at least a pair of interconnected strips, with each strip having a portion extending into opposite corners of the opening or, if more than two strip form the panel, the strips extend parallel to lines extending diagonally between opposite corners.

Instead of providing a suspended ceiling which is closed by solid panels received in openings formed by a grid of main runners with cross runners, it has been desirable to provide an open ceiling which has an open grid with openings extending into the ceiling, such as a louver structure. Examples of these are disclosed in U.S. Pat. Nos. 3,291,978 and 4,034,534. In the devices disclosed in each of these patents, the slats or members extend parallel to the main runners and cross runners. It has also been suggested to provide an open grid assembly in which each of the openings have the same size and the slats or members forming the grids extend at right angles to each other and parallel to the main runners and cross runners. It has also been proposed to form an open screen assembly wherein the inserts provide openings of different sizes and shapes. Such an example is disclosed in U.S. Pat. No. 4,625,470.

Other open ceiling arrangements include suspending baffles or strips from a grid system to provide an illumination-type grid which will allow passage of light and/or air from the space above the grid work into the interior of the room. An example of the use of baffles is disclosed in U.S. Pat. No. 3,774,024, whereas the use of strips are shown in U.S. Pat. Nos. 3,755,988 and 4,720,954. Another advantage of a large open cell system or open ceiling arrangement occurs during remodeling. When you use the large open cell system, you can leave intact the sprinkler system, the H-VAC system and even the lighting system.

One of the problems which can occur is to obtain proper alignment of the elements so that a repeating pattern is generated. The open grid work screen assembly of U.S. Pat. No. 4,625,470 accomplishes this by providing hooks on the ends of the inserts which engage in slots provided on the cross members or runners. Such an arrangement will increase the cost of producing the ceiling structure and also the cost of installing the structure.

SUMMARY OF THE INVENTION

An object of the present invention is to provide an open cell lay-in panel for receiving rectangular or square openings formed in a grid structure of main runners and cross runners, which can be easily assembled with the panels being held in perfect alignment with adjacent panels so that panels coact with adjacent panels to form a cube-like structure.

To accomplish these goals, the open cell lay-in panels are constructed to be inserted in rectangular, or preferably square, openings formed by a ceiling grid formed by parallel main runners with cross runners, with each of the runners preferably having a cross section of an inverted tee so that the flanges of the tee lay in substantially a single plane with the insert panel being formed by at least a pair of strip members which are interconnected to each other, with each strip member having a portion received in the opposite corner of the opening or, if there are more than a pair of strip members, each of the strip members having portions extending parallel to one of the two diagonal lines extending between opposite corners of the opening.

In the first embodiment, a pair of strip members are interconnected at their centers and extend substantially along the diagonals of each of the openings so as to divide each of the openings into four equilateral triangles. Modifications of this include bending each of these strips so that only portions adjacent each of the corners extend along the diagonal and other portions extend parallel to the runners adjacent the center to provide a differently shaped pattern. In another modification, these strips are bend into shallow curves or into a serpentine configuration.

In each of these embodiments, the strips can be constructed to have connecting elements at the ends for suspending the panel in the opening with a portion of the panel extending below the plane of the flanges of the grid. These can be arranged so as to have a large percent or a gradual curved portion of the strip extending below the panel.

In another modification, the ends of the strip are bent in a Z-shape so that when the two strips are interconnected, these outer legs of the Zs can be interconnected to adjacent corners of the strip to form a box with the two diagonal extensions.

In another embodiment, the two strips do not have portions extending diagonally along the diagonal, but each strip has four right angle bends and the two strips coact together to form four boxes. The ends of these strips are provided with tabs for insertion into openings formed in the adjacent strip to enable holding the various pieces in the assembled relationship.

In another embodiment of the device, four strips are used, with two strips extending parallel to each other and at right angles to the other pair of two strips. These strips form a grid which has portions extending parallel to the diagonals of the opening. Of this arrangement, the ends of the strips can be open so that a pattern of an open cross is formed at the center of four openings. In a modification, each of the strips has a right angle leg so as to form a closed end adjacent each parallel strip to produce a plurality of cubes which have the sides extending diagonally to the direction of the main runners and cross runners.

Other advantages and features of the invention will be readily apparent from the following description of the preferred embodiments, the drawings and claims.

DESCRIPTION OF THE PREFERRED EMBODIMENTS

Figure 1:
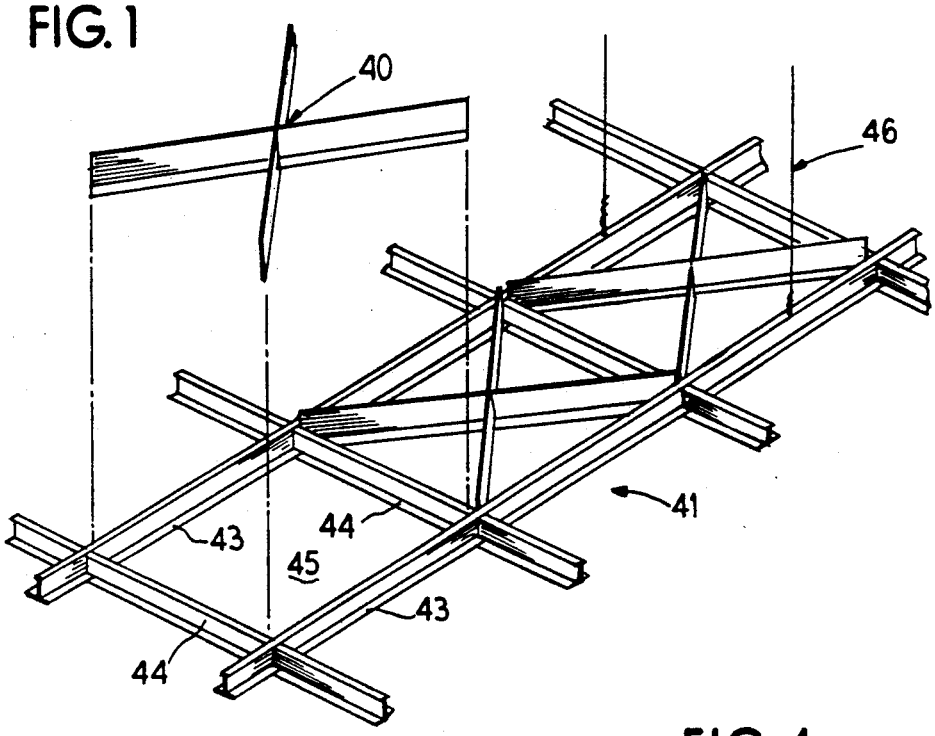
FIG. 1 is a perspective view of the open cell lay-in panel of the present invention inserted in a suspended ceiling grid structure.

The principles of the present invention are particularly useful in a lay-in panel structure or insert generally indicated at 40 in FIG. 1, for an open cell suspended ceiling, generally indicated at 41 in FIG. 1.

Figure 12:
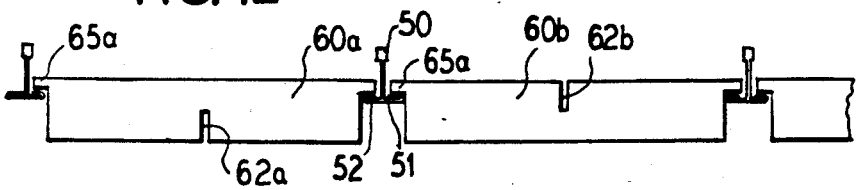
FIG. 12 is a cross sectional view showing a modification of the cells hanging below the plane of the grid formed by the runners.
Figure 13:
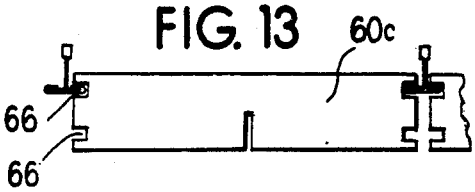
FIG. 13 is a cross sectional view similar to FIG. 12 with the modification of the cells hanging below the plane of the grid.

The open cell suspended ceiling 41 is formed by a plurality of main runners 43, 43, which are suspended from a ceiling of the building by wires, such as 46. To form a grid, a plurality of cross members or runners 44 extend between adjacent main runners 43 to form rectangular openings 45 which, as illustrated, preferably have a square configuration of approximately two feet on each side. Each of the main runners 43 and the cross members or runners 44 have a shape of an inverted tee. As illustrated in FIG. 12, these inverted tees are formed of a strip of material which is bent to have a bead 50 with two webs extending downward to flanges 51, 51. A cap strip 52 covers the bottom of the flanges and is visible from the enclosure so that the desired color can be provided for each of the runners.

Figure 2:
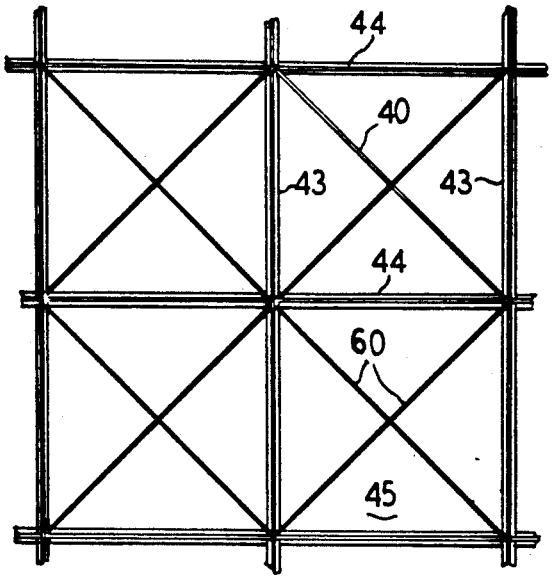
FIG. 2 is a top plan view of the ceiling structure of FIG. 1.
Figure 3:
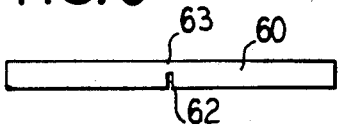
FIG. 3 is a side view of one of the strips for forming the open cell lay-in panel of FIG. 2.
Figure 20:
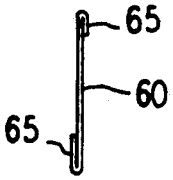
FIG. 20 is an end view of a member for forming the open cell panels.

As illustrated in FIGS. 2 and 3, each of the open cell lay-in panels 40 are formed by two strips or members 60, which, as shown in FIG. 3, have a slot 62 at the center or midpoint of the strip which slot extends half way through the height of the strip to leave an unslotted portion 63. Two strips 60 can be interconnected by having the slot 62 of one strip receiving the unconnected portion 63 of the other strip. Each of the strips 60 can be provided with raw upper and lower edges or, as illustrated in FIG. 20, can have the upper and lower edges rolled over to form a double thickness 65. This rolling over also increases the rigidity of the member, as well as providing a smooth, uncut edge to be seen by the observer in the room having the ceiling of the present invention.

In the embodiment of FIG. 2, the two strips 60 are interconnected at the center of each of the square openings 45 by a single connection as their ends are placed in opposite corners of each of the openings 45 and have edges of the strips resting on the flanges of the main runner. As illustrated, the panel 40 whose strips 60 lie in planes extending substantially perpendicular to a plane formed by the flanges, subdivides the main opening 45 into four isosceles triangles and each of these triangles coacts with a triangle in the next adjacent opening to form a cube having a length which is approximately one-half of the diagonal length between two corners of the opening 45. As can be seen from FIG. 2, there is no problem with obtaining the proper alignment of the panels of adjacent openings, since the ends of each of the strips 60 are received in the corners, which insure a proper positioning. Also, the mounting or positioning of these strips is easily obtained by merely laying the panel into the opening defined by the runners 43 and 44.

In the embodiment illustrated in FIGS. 1, 2 and 3, the height of each of the strips 60 is greater than the height of the runners 43 and 44 to provide visual screening and the panels do not extend below a plane formed by the flanges of the grid formed by the runners. To increase the degree of visual screening for a given size opening, the height of the strips 60 must be increased. For example, if the opening 45 is 12" by 12", a 45° screening requires strips 60 which are 12" in height.

Instead of obtaining visual screening by extending above the beads of the runner, the strip can extend below the flanges. As illustrated in FIG. 12, each of the strips **60*a* or 60*b* have projections 65*a* at each end to allow hanging the strip between the flanges, such as 51, of two runners with a majority of the strip, such as 60*a* or 60*b*, extending below the plane formed by the flanges 51 of the runners. Since each of the ears or projections 65*a* is adjacent an upper edge, the strip 60*a* is similar to the strip 60*b*, except for the position of the slot 62*a* and the slot 62*b*. As illustrated, the slot 62*b* is on an upper edge, while the slot 62*a* is on a lower edge so that the two strips 60*a* and 60*b* can be interconnected by having the slots coact to receive the unslotted portion of the opposite strip. It should be noted that when the strip does not have anything to distinguish an upper edge from a lower, such as the strip 60 of FIG. 3**, two strips can be joined together by turning one through 180° relative to the other.

Instead of providing ears or projections **65*a* for hanging the assembly on the runners, a modified strip 60*c* is provided with a pair of spaced notches 66 at each end. Thus, two strips 60***c* can be joined together to form a structure, such as the panel 40, and have the upper notches snapped onto the flanges to suspend the device with a portion extending below the plane of the flanges.

Figure 4:
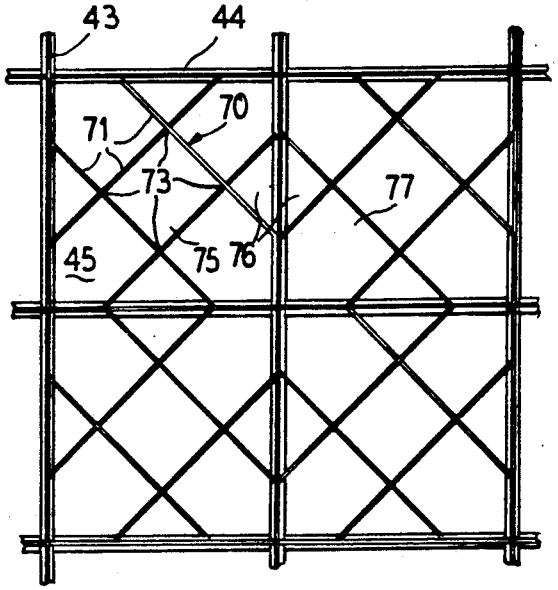
FIG. 4 is a top plan view of an embodiment of the open cell lay-in panel in accordance with the present invention.
Figure 5:
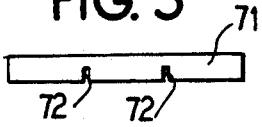
FIG. 5 is a side view of one of the strips forming the open cell lay-in panel of FIG. 4.

An embodiment of the panel or insert is generally indicated at 70 in FIG. 4. In this embodiment, the panel is formed by four strips or strip members 71, with each of these strips, as illustrated in FIG. 5, having two spaced notches 72, 72, which divide the strip into approximately three equal sections. The four strips 71, as illustrated in FIG. 4, are interconnected by four connections 73, which are formed by the coacting slots 72. Thus, the panel 70 is composed of two parallel extending strips or members and two parallel extending cross members, with the members extending parallel to a diagonal extending between opposite corners of the opening in the grid formed by the runners. The panel 70 will have a small square 75 in the center of the opening, which will be surrounded by four isosceles triangular openings 76, which will coact with additional triangular openings of adjacent panels to form squares similar to the square 75. Adjacent the ends, the opening between two of the strips 71 coacts with adjacent openings to form a cross configuration, such as 77. The panel 70 is easily aligned once inserted into the opening, such as 45, formed by the runners 43 and 44 and the adjacent panels 70 will always be aligned with each other.

Figure 9:
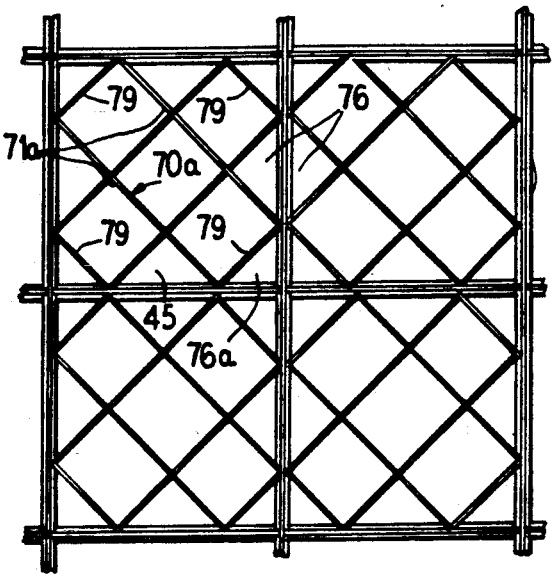
FIG. 9 is a top plan view of a modification of the embodiment of the open cell lay-in panel of FIG. 4.
Figure 10:
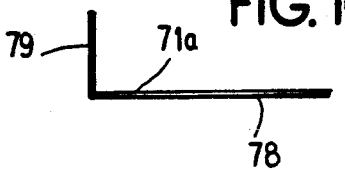
FIG. 10 is a plan view of an element or strip used in forming the modification of the open cell lay-in panel of FIG. 9.
Figure 8:
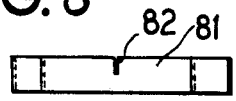
FIG. 8 is a side view of the strip of FIG. 7.
Figure 11:
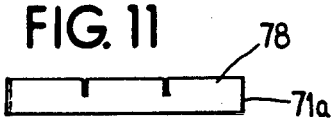
FIG. 11 is a side view of the element illustrated in FIG. 10.

Another modification of the arrangement of FIG. 4 is illustrated in FIGS 9, 10 and 11. In this modification, each of the strips 71*a*, as illustrated in FIG. 10, has an L-shaped configuration with a main leg portion 78 and a small leg 79. The small leg is approximately ⅓ of the length of the main leg 78 so that when assembled, as illustrated in FIG. 9, the small legs 79 close off the ends between two adjacent strips 71*a*, 71*a* so that the four strips of the panel or insert 70*a* form five small squares or cubes when assembled. When the panel 70*a* is inserted in the opening, such as 45, it then will also form the four isosceles triangles 76 plus four smaller isosceles triangles 76*a*, which are adjacent each of the corners of the opening 45. The overall effect, as illustrated in FIG. 9, is a plurality or cubes or squares extending across the extent of the ceiling. It should be noted that each of the strips, whether it is the strip 71 or the strip 71*a*, can be of a single thickness or have the rolled-over upper and lower edges, such as illustrated in FIG. 20.

Figure 6:
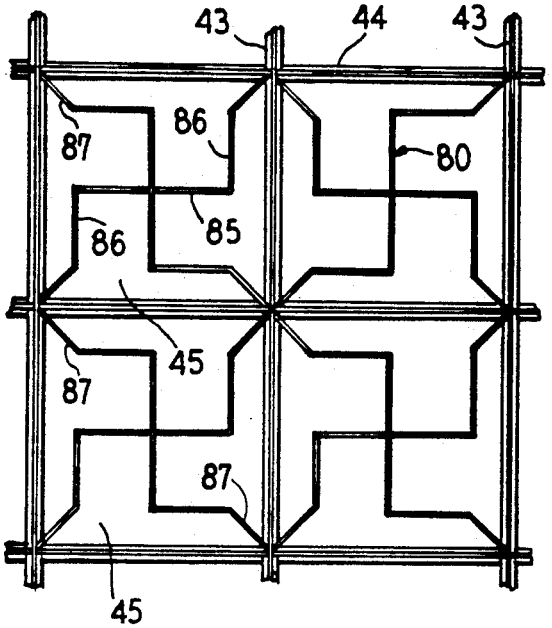
FIG. 6 is a top plan view of a modification of the open cell lay-in panel of FIG. 2.

As discussed hereinbefore, the panel 40 of FIGS. 1 and 2 had a single connection between the two strips. A variation of the panel or insert 40 is illustrated by the panel 80 of FIG. 6, which is formed by two members 81, 81, which have a slot 82 at the center and are provided with two right angle bends 83, 83 and two partial bends 84, 84 (see FIG. 7). When the two strips or members 81 are assembled together, they will have portions, such as a portion 85, between the two right angle bends 83 which will extend parallel to the runners 43 and 44. Each of the strips will also have second portions 86, 86 adjacent the bends 83, which will also extend parallel to one of the runners, while the end portions 87 which extend into each of the opposite corners will extend parallel to each other and be on a diagonal extending between opposite corners of the square opening 45.

Figure 16:
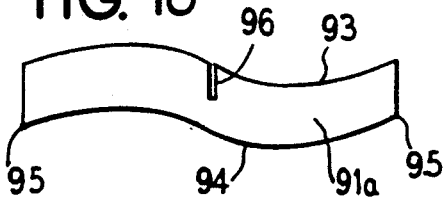
FIG. 16 is a side view of an element for forming the cell having a curved configuration.
Figure 17:
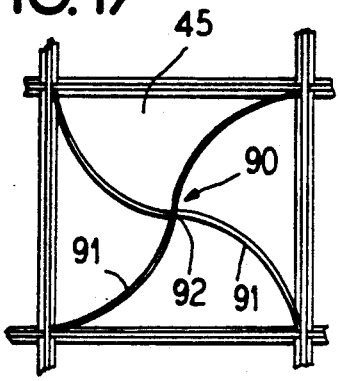
FIG. 17 is a plan view showing an open cell lay-in panel having curved members.
Figure 18:
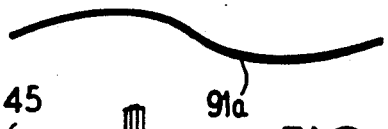
FIG. 18 is a top view of the element of FIG. 17 showing the curve configuration.

Another modification is illustrated in FIG. 17, wherein the panel or insert is formed of two strips 91 connected at the center by a connection 92 formed by slots similar to the slots 62 of the strips 60. In this arrangement, both of the members 91 have a length greater than the diagonal distance between opposite corners of the opening 45 so that each of the members 91 has a curve of a flattened sine wave. The element 91 can have parallel extending upper and lower edges, such as the strips 60 of FIG. 3, or the element can have curving edges, such as an element 91*a* of FIG. 16. As illustrated in FIG. 16, the element 91*a* has an upper surface 93 and a lower surface 94 which follow a flattened sine curve so that a portion of the strip or member 91*a* is lower than the corner 95, 95 and, thus, when the panel formed by two of these members 91*a* is inserted in the opening 45 with the corners 95 resting on the flanges of the runners, a portion of the panel will be above the plane of the flanges while another portion will extend below the plane to give a three-dimensional effect to the panel being formed. As in the previous embodiments, the connection, such as 92, is formed by slots, such as 96, that coact with the slot of the other member 91*a* to form the panel.

Figure 14:
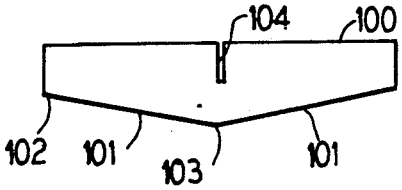
FIG. 14 is a side view of an element of the cell having a portion extending below the corners of the members.

The strips or members 91*a* of FIG. 16 are designed to have a portion extend below the plane of the flanges. Another embodiment of a strip which can have a portion extending below the plane of the flange is the strip member 100 of FIG. 14. The strip member 100 has lower edges 101, 101, which slope downward from the corners 102 to intersect at a point 103, which is on the center of the strip 100. The strip, as illustrated, is provided with a slot 104. Since the upper and lower edges are not symmetrical, it coacts with another strip (not illustrated) that has a slot extending from the apex or point 103 inward in a manner similar to the strips 60*a* of FIG. 12.

Figure 15:
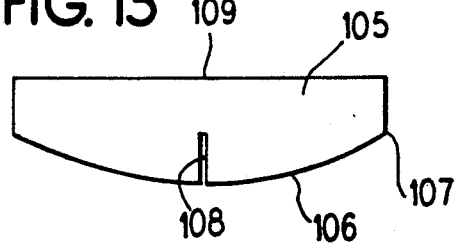
FIG. 15 is a side view of another modification of the cell having portions extending below the corners.

In FIG. 15, another strip member 105 is illustrated which has a lower edge formed by a curved surface 106 that extends below the corners 107. Thus, when an open cell panel is formed by two of these strips 105, a curved surface will extend below the plane of the flanges for each of the strips or members 105. As mentioned above with regard to the member 100, a slot 108 extends inward from the curved surface 106 and the strip member 105 coacts with a similarly shaped strip member having a slot extending from an upper edge, such as 109.

Figure 19:
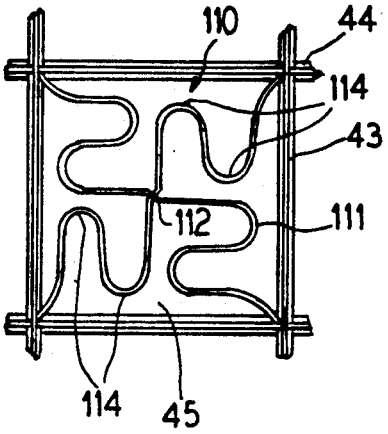
FIG. 19 is a top plan view of a modification of an open cell lay-in panel having curved members with multiple curves and bends.

In FIG. 17, a panel or insert 90 having curved surfaces is illustrated. In a modification, a panel 110 is shown in FIG. 19. This is formed of two strip members 111, which are interconnected together at a center point 112 in a manner similar to the interconnection of the other, previously-mentioned panels. Each of the strips or members 111 have a plurality of curves, for example return bends 114, 114, to form a serpentine configuration, as illustrated in FIG. 19. Thus, when the panel 110 is inserted into the opening 45 formed by the runners 43 and 44, the opening 45 will be sub-divided into a plurality of smaller openings having curved edges or surfaces.

Figure 21:
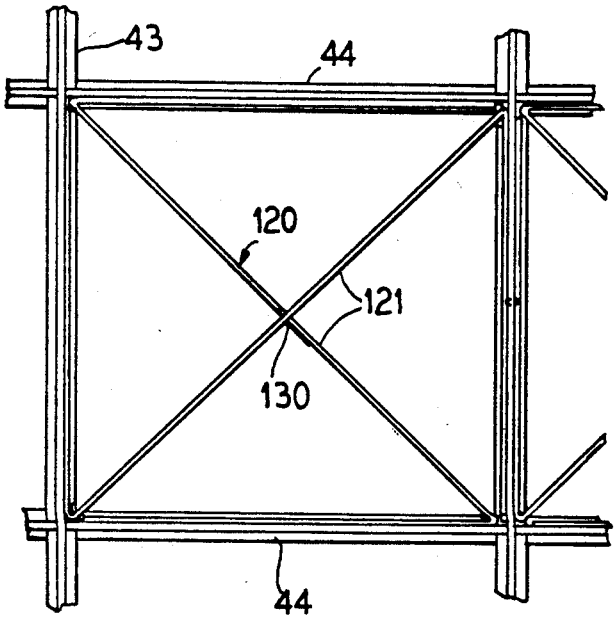
FIG. 21 is a plan view of a modification of an open cell lay-in panel.

In each of the previously discussed panels, such as the panel 40, 70, 70*a*, 80, 90 and 110, the panels are opened adjacent the sides so that the web and bead of each of the runners 43 and 44 will be visible from the interior of the room. In the next two inserts or panels 120 of FIG. 21 and 140 of FIG. 25, the panels have enclosed outer peripheries so that the bead and webs of the runners, such as 43 and 44, will not be visible.

Figure 22:
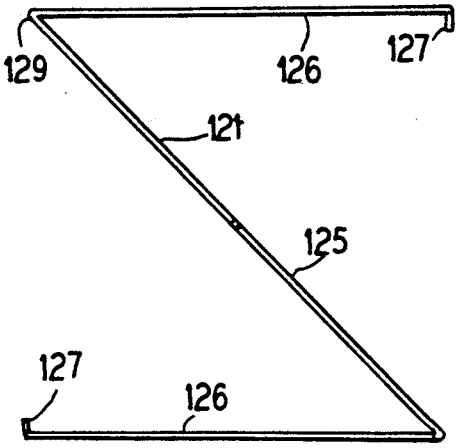
FIG. 22 is a top plan view of an element for forming the open cell lay-in panel of FIG. 21.
Figure 23:
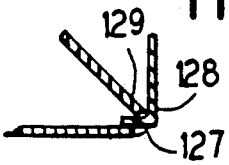
FIG. 23 is an enlarged cross sectional view of a corner showing a connection of the panels.
Figure 24:
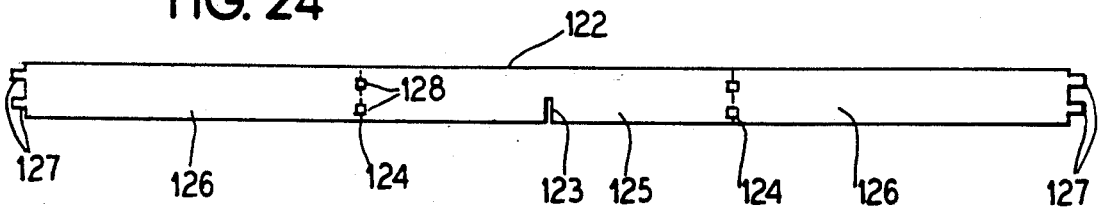
FIG. 24 is a side view of an unfolded strip element used for forming the element illustrated in FIG. 22.

In the embodiment illustrated in FIGS. 21–24, the panel 120 is formed by two Z-shaped strip members 121, 121. Each of the strip members 121, 121 is bent from an elongated strip 122 of FIG. 24. The strip 122, at the center or midpoint, is provided with a half-slot 123, as in the previous embodiments. The strip is provided with bend lines 124, 124, which divide the strip 122 into three equal parts, with a center part 125 and two end parts 126, 126. By bending on the bend lines 124, 124, a Z-shaped configuration, such as illustrated in FIG. 22, is obtained with the two ends 126, 126 extending substantially parallel to each other at an angle of approximately 45° to the center part 125. Preferably, the ends of each of the end sections 126 are provided with a pair of tabs 127 and slots 128 are arranged on each of the bend lines 124, 124 so that a bend 129 will have slots for receiving the tabs 127 of the other member as a connection 130 is formed by the slots 123 coacting together, as in the previous embodiments. To complete the formation, each of the tabs 127 has been bent at right angles to its respective leg 126 and is received in the slot 128, as best illustrated in FIG. 23.

In this configuration, the panel 120 comprises a square box formed by the portions 126 with the two diagonals 125, 125. As mentioned, the portions or legs 126 that form the square box cover up or mask the web and beads of each of the runners 43 and 44 from a viewer in the room. Thus, the viewer will only see the cap strips, such as 52, of each of the runners and the panel 120, which allows a wide selection of colors for the open cell ceiling.

Figure 25:
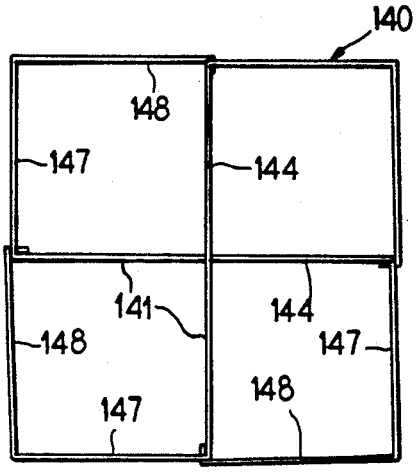
FIG. 25 is a top plan view of another embodiment of the open cell lay-in panel in accordance with the present invention.
Figure 26:
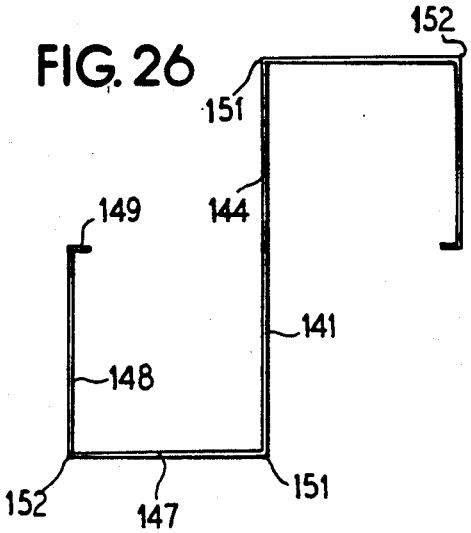
FIG. 26 is a top plan view of an element used to form the embodiment of FIG. 25.
Figure 27:
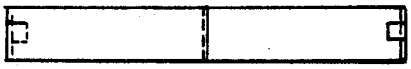
FIG. 27 is a side view of the element of FIG. 26.
Figure 28:
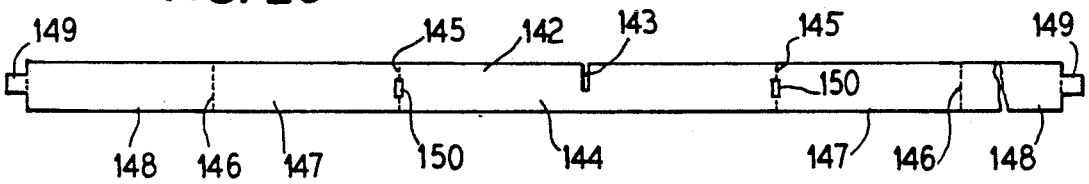
FIG. 28 is a side view of the unfolded element of FIG. 26.
Figure 29:
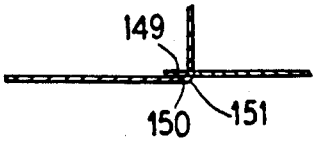
FIG. 29 is a partial cross sectional view illustrating a modification in the connection of ends of two of the elements of FIG. 26 to form the panel of FIG. 25.

A variation of the closed box with the cross members is illustrated by the panel 140 of FIG. 25. The panel 140 is formed by two members 141, which have the shape illustrated in FIG. 26. Each of the members 141 is formed from a single strip 142 (FIG. 28), which, at a midpoint, has a half-slot 143. The strip 142 has a center portion 144 having the slot 143, and the center portion 144 is approximately ⅓ of the length of the strip 142. The center portion is defined by first bend lines 145, 145. The second bend lines 146, 146 sub-divide each of the end portions into two portions 147 and 148, which have a length of half the length of the center portion 144. Each of the end portions 148 is provided with a tab 149. Finally, each of the first bend lines 145, 145 are provided with a slot, such as 150, which is aligned with the tabs 149. By bending on the lines 145, the portion 144 is connected by right angle bends 151 (FIG. 26) to a first partial outer leg formed by the portion 147. Another right angle bend 152 is formed on each of the bend lines 146 so that the portion 148 extends at right angles to the portion 147, as illustrated in FIG. 26, and parallel to the portion 144. Finally, each of the tabs 149 are bent at right angles. When two of the members 141 are assembled together, the panel 140 is formed with the tabs 149 of one member 141 extending into the slots 150, as illustrated in FIG. 25, to form a rigid square box, which is sub-divided into four smaller squares by the center portions 144, 144. A modification of the connection formed by the tabs 149 in the slots 150 is shown in FIG. 29. In this modification, the tabs are not bent into the slots 150, which, as illustrated, have a size great enough to extend around the bend 151.

As in the previous embodiment of the panel 120, when the panel 140 is inserted in an opening formed by the runners, the side walls, such as formed by the portions 147 and 148, coacting together will mask or cover the web and bead of the runner. It is also noted that, due to the insertion of the various tabs 149 in the slots 150, the unit is substantially rigid and the portions 144 will be aligned with the portions 144 of adjacent panels.

Figure 7:
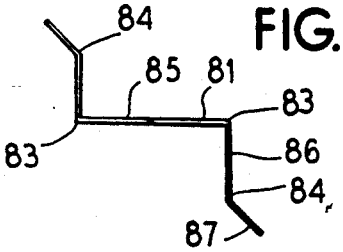
FIG. 7 is a top plan view of a single strip forming the modification of FIG. 6.

In each of the panels, whether it is the panel 140 of FIG. 25 or the panel 40 of FIG. 2, they are assembled on site from either strips or from pre-bent members, such as the member 81 of FIG. 7, or the pre-bent members 71*a* of FIG. 10. In the embodiments of the panels 120 and 140, the elongated strip can be shipped to the site in an unbent form and bent at the site. To facilitate bending, each of the bend lines, such as 124 for the strip 122 of FIG. 24 or the bend lines 145 and 146, are provided with slits to facilitate the bending and with the additional slots, such as 128 or 150, for receiving the tabs. In most instances, except when the strip member has a specific shape, such as the members 60*a* and 60*b* of FIG. 12, the member 100 of FIG. 14 or the member 105 of FIG. 15, the two members are the same and are assembled together with only the requirement that one be turned through 180° so that its respective half-slot can coact with the half-slot of the other member. In the above-mentioned strips, such as 105, two sets are necessary, since the elements cannot be rotated or flipped through the 180°.

Although various minor modifications may be suggested by those versed in the art, it should be understood that I wish to embody within the scope of the patent granted hereon all such modifications as reasonably and properly come within the scope of my contribution to the art.

I claim:

1. A structure for a suspended ceiling having an open-cell configuration, said ceiling comprising parallel extending main runners and parallel extending cross runners arranged to form a series of rectangular openings, each of said runners having a cross sectional shape of an inverted tee with flanges; an insert received in each of said rectangular openings, said insert including a pair of strip members being interconnected to each other, each of the strip members having a portion received in opposite corners of the opening to support the insert on the flanges of said runners, and each of the strip members having a fold-over portion adjacent an upper and lower edge thereof.

2. A structure according to claim 1, wherein each of the strip members has a slot at a midpoint of the strip member extending half-way through the width of the member coacting with the slot of the other member to form the interconnection.

3. A structure according to claim 2, wherein each of the strip members has at least a portion extending parallel to a diagonal extending between said opposite corners.

4. A structure according to claim 3, wherein the portion extends the entire length of a diagonal extending between said opposite corners.

5. A structure according to claim 4, wherein each of said strip members consist only of said portion extending between the opposite corners.

6. A structure for a suspended ceiling having an open-cell configuration, said ceiling comprising parallel extending main runners and parallel extending cross runners arranged to form a series of rectangular openings, each of said runners having a cross sectional shape of an inverted tee with flanges; an insert received in each of said rectangular openings, said insert including a pair of strip members, each of the strip members having a slot at a midpoint of the strip member extending half-way through the width of the member coacting with the slot of the other member to form an interconnection to interconnect the strip members together, each of the strip members being formed of at least three portions interconnected by two bends, and each of the strip members having a portion received in opposite corners of the opening to support the insert on the flanges of said runners.

7. A structure according to claim 6, wherein each of the strip members has at least one of the portions extending parallel to a diagonal extending between said opposite corners.

8. A structure according to claim 6, wherein each of the strip members has one portion extending the entire length of a diagonal extending between said opposite corners and ending with said bends and the strip member has a portion bent at the corner to extend along the runner to form a closed rectangular box for said structure.

9. A structure according to claim 8, wherein each bend of the strip member has a slot and the end of each strip member has a tab received in the slot to rigidly hold the end of a strip member relative to the bend of the adjacent strip member.

10. A structure according to claim 7, wherein each of the strip members has two right-angled bends and two 45° bends to form five portions, with three of the portions extending between the two portions extending on the diagonal between opposite corners.

11. A structure according to claim 6, wherein said two bends are right angle bends.

12. A structure according to claim 11, which includes two additional bends to form five portions for each strip member.

13. A structure according to claim 12, wherein said two additional bends are right angle bends.

14. A structure according to claim 12, wherein said additional bends create portions having a smaller length than the portion extending between the first two bends.

15. A structure according to claim 6, wherein each of the strip members has portions extending parallel to the runners forming said opening.

16. A structure according to claim 15, wherein said portions extending parallel to said runners coact with portions of the other strip member to form an enclosed outer wall for said structure having a rectangular configuration.

17. A structure according to claim 16, wherein each of the strip members has a tab at each end for receiving in a slot provided at bend line of the other strip member to support each end relative to a bend of the other member.

18. A structure for a suspended ceiling having an open-cell configuration, said ceiling comprising parallel extending main runners and parallel extending cross runners arranged to form a series of rectangular openings, each of said runners having a cross sectional shape of an inverted tee with flanges; an insert received in each of said openings, said insert including a pair of strip members having a slot at a midpoint of the strip member extending half-way through the width of the member coacting with the slot of the other member to form the interconnection to interconnect the members together, each of the strip members having an edge of a portion received in opposite corners of the opening to support the insert on the flanges of said runners, and each of the strip members has a portion extending below a lower corner of the strip member so that a portion of the insert will extend below a plane formed by the flanges of the runners.

19. A structure according to claim 18, wherein a lowest point of said portion is a lower edge and is adjacent the center of each strip member.

20. A structure according to claim 18, wherein a lowest point of said portion is offset from the center of each of the strip members.

21. A structure according to claim 18, wherein each of the strip members has means on the end for suspending the strip members on the flanges of said runners with said portion of the strip member extending below the plane formed by the flanges of said runners.

22. A structure according to claim 21, wherein each of said means includes a cut-out forming a projection on the end of each of said strip members.

23. A structure according to claim 21, wherein said means includes a pair of notches spaced along the height of said strip.

24. A structure for a suspended ceiling having an open-cell configuration, said ceiling comprising parallel extending main runners and parallel extending cross runners arranged to form a series of rectangular openings, each of said runners having a cross sectional shape of an inverted tee with flanges; an insert received in each of said rectangular openings, said insert including a pair of strip members having a slot at a midpoint of the strip member extending half-way through the width of the member coacting with the slot of the other member to form an interconnection to interconnect the members together, each of the strip members having an edge of a portion received in opposite corners of the opening to support the insert on the flanges of said runners, and each of the strip members having at least one curved portion so that the strip member does not extend along a straight line as it extends between the opposite corners.

25. A structure according to claim 24, wherein each of the strip members has at least two reversed bends to form a meandering path between the two opposite corners.

26. A structure for a suspended ceiling comprising parallel main runners and parallel extending cross runners coacting with said main runners to form substantially rectangular openings, each of said runners having a cross section of an inverted tee with outwardly extending flanges adjacent a lower edge thereof, an insert being supported in the opening on said flanges, said insert being formed by four identical strip members with two strip members extending parallel to each other and being interconnected to the other two strip members extending at right angles thereto, each of said strip members having at least one portion extending parallel to a diagonal extending between opposite corners of said opening.

27. A structure according to claim 26, wherein said openings are square openings.

28. A structure according to claim 27, wherein each of the strip members has a right angle bend connecting a second smaller portion having a length equal to the spacing between two parallel strip members so that the insert provides a plurality of square cubes extending parallel to a diagonal extending through opposite corners of said square opening.

29. A structure according to claim 26, wherein each of the strip members includes a bend so that the member has at least two portions.

30. A structure for a suspended ceiling comprising parallel main runners and parallel extending cross runners coacting with said main runners to form substantially rectangular openings, each of said runners having a cross section of an inverted tee with outwardly extending flanges adjacent a lower edge thereof, an insert being supported in the opening on said flanges, said insert being formed by at least two strip members interconnected together, each of said strip members having at least one portion extending parallel to a diagonal extending between opposite corners of said opening, and each of the strip members having a fold-over portion adjacent an upper and a lower edge.

* * * * *